US006935623B2

(12) United States Patent
Cook et al.

(10) Patent No.: US 6,935,623 B2
(45) Date of Patent: Aug. 30, 2005

(54) FENCE ASSEMBLY WITH CONNECTORS

(75) Inventors: James Christopher Cook, Greenfield, OH (US); Paul R. Pelfrey, Wheelersburg, OH (US)

(73) Assignee: Crane Plastics Company LLC, Columbus, OH (US)

( * ) Notice: Subject to any disclaimer, the term of this patent is extended or adjusted under 35 U.S.C. 154(b) by 0 days.

(21) Appl. No.: 10/817,481

(22) Filed: Apr. 2, 2004

(65) Prior Publication Data

US 2004/0188665 A1 Sep. 30, 2004

Related U.S. Application Data

(62) Division of application No. 10/243,626, filed on Sep. 13, 2002.

(60) Provisional application No. 60/322,074, filed on Sep. 14, 2001.

(51) Int. Cl.[7] ..... E04H 17/14

(52) U.S. Cl. ..... 256/65.08

(58) Field of Search ..... 256/65.01, 65.08, 256/65.15; 403/292, 298, 223

(56) References Cited

U.S. PATENT DOCUMENTS

| | | | | |
|---|---|---|---|---|
| 438,122 A | | 10/1890 | Thorp | 256/48 |
| 1,964,657 A | | 6/1934 | Austin | 173/46 |
| 2,465,276 A | | 3/1949 | Ryder | 264/275 X |
| 2,685,432 A | | 8/1954 | Murray, Jr. et al. | 256/22 |
| 3,158,224 A | | 11/1964 | Van Name et al. | 403/268 X |
| 3,200,554 A | | 8/1965 | Goodman et al. | 52/727 |
| 3,256,659 A | | 6/1966 | Dudoff | 52/301 |
| 3,437,059 A | * | 4/1969 | James et al. | 403/220 X |
| 3,991,146 A | | 11/1976 | Barrie | 264/46.7 |
| 4,010,504 A | | 3/1977 | Griffin | 16/158 |
| 4,035,978 A | | 7/1977 | Bajorek et al. | 52/727 |

(Continued)

FOREIGN PATENT DOCUMENTS

| | | |
|---|---|---|
| FR | 2.102.577 | 4/1972 |
| JP | 5-202648 | 8/1993 |

*Primary Examiner*—John R. Cottingham
(74) *Attorney, Agent, or Firm*—Standley Law Group LLP

(57) ABSTRACT

The present invention is a fence assembly comprising fence segments and connectors. Each fence segment may be secured to another fence segment by a connector. The present invention may use in-line connectors, living hinge connectors, male/female hinged connectors, and/or end caps. The connectors may be adapted to fit into the hollow channel rails by a friction fit, press fit, adhesion, or any other suitable connecting means.

15 Claims, 8 Drawing Sheets

U.S. PATENT DOCUMENTS

| | | | | | |
|---|---|---|---|---|---|
| 4,037,788 | A | | 7/1977 | Riley | 239/207 |
| 4,038,802 | A | | 8/1977 | Bajorek et al. | 52/731 |
| 4,043,721 | A | | 8/1977 | Lemelson | 425/116 |
| 4,067,547 | A | * | 1/1978 | Peters | 256/23 |
| 4,103,875 | A | | 8/1978 | Glass | 256/59 |
| 4,145,031 | A | | 3/1979 | Baker, II | 256/65 |
| 4,270,872 | A | | 6/1981 | Kiyosawa | 403/170 |
| 4,356,999 | A | | 11/1982 | McShane | 256/26 |
| 4,361,314 | A | | 11/1982 | Ohlson | 256/65 |
| 4,369,000 | A | * | 1/1983 | Egnew | 403/220 X |
| 4,381,908 | A | | 5/1983 | Roth | 425/129 R |
| 4,470,579 | A | | 9/1984 | Aho | 256/10 |
| 4,516,756 | A | | 5/1985 | Beatty | 256/1 |
| 4,702,459 | A | | 10/1987 | Moschner | 256/19 |
| 4,722,514 | A | | 2/1988 | Pettit | 256/50 |
| 4,787,475 | A | | 11/1988 | Arteau et al. | 182/82 |
| 4,858,891 | A | | 8/1989 | Boes | |
| 4,951,925 | A | | 8/1990 | Schultz et al. | |
| D315,415 | S | | 3/1991 | Anthony et al. | |
| 5,078,367 | A | | 1/1992 | Simpson et al. | |
| 5,127,762 | A | | 7/1992 | Havlovitz | |
| 5,167,049 | A | | 12/1992 | Gibbs | |
| 5,240,230 | A | | 8/1993 | Dougherty | |
| 5,301,926 | A | | 4/1994 | Sharp | |
| 5,303,900 | A | | 4/1994 | Zulick, III et al. | |
| 5,340,086 | A | | 8/1994 | Dorr | |
| 5,362,030 | A | | 11/1994 | Iler, Jr. et al. | |
| 5,419,536 | A | | 5/1995 | Bender | |
| 5,421,556 | A | | 6/1995 | Dodge et al. | |
| 5,507,473 | A | | 4/1996 | Hammer et al. | |
| 5,613,664 | A | | 3/1997 | Svalbe | |
| 5,626,331 | A | | 5/1997 | Erwin | |
| 5,645,270 | A | | 7/1997 | Lawrence | |
| 5,674,089 | A | | 10/1997 | Sampson | |
| 5,722,205 | A | | 3/1998 | Gannaway | |
| 5,755,431 | A | | 5/1998 | Williams | |
| 5,853,167 | A | | 12/1998 | West et al. | |
| 5,857,664 | A | * | 1/1999 | Schauman | 256/19 |
| 5,876,021 | A | | 3/1999 | Spence et al. | |
| 5,927,694 | A | | 7/1999 | Montepiano | |
| 5,931,450 | A | | 8/1999 | Yoder | |
| 6,022,047 | A | * | 2/2000 | Okubo | 403/220 X |
| 6,039,307 | A | | 3/2000 | De Zen | |
| 6,076,807 | A | | 6/2000 | Spence | |
| 6,092,823 | A | * | 7/2000 | Busby | 280/284 |
| 6,138,422 | A | | 10/2000 | Wall et al. | |
| 6,176,462 | B1 | | 1/2001 | Jansen | |
| 6,257,559 | B1 | | 7/2001 | Mouri | |
| 6,565,069 | B2 | | 5/2003 | Morris | |
| 6,568,658 | B2 | | 5/2003 | Strome | |
| 2002/0066248 | A1 | | 6/2002 | Buhrts et al. | 52/301 |
| 2003/0030047 | A1 | * | 2/2003 | Ohanesian | 256/24 |
| 2004/0135134 | A1 | * | 7/2004 | Rice | 256/32 |

* cited by examiner

FENCE ASSEMBLY WITH CONNECTORS

CROSS REFERENCE TO RELATED APPLICATIONS

This is a divisional of U.S. application Ser. No. 10/243,626, filed Sep. 13, 2002, which claims the benefit of U.S. Provisional Application No. 60/322,074, filed Sep. 14, 2001, each of which is hereby incorporated by reference in its entirety.

BACKGROUND AND SUMMARY OF THE INVENTION

The present invention relates generally to fences, and more particularly, to fastening a fence segment to another fence segment. Fences have been used in various forms for thousands of years to protect and secure people, animals and land. Fences have also been used to exclude intruders. Specifically, farmers have used fences to contain live stock and domestic animals in a controlled area or to prevent predators from entering. While these functional fence uses continue today, fences are also used for decorative purposes such as on porches and around yards, decks and gardens.

The type of use a fence is intended to have will have an effect on the type of material used for the fence. Fencing material comes in a wide array of materials, traditionally including wood and wrought iron. However, wood fences tend to require extensive effort to build, need a lot of maintenance and can be difficult to remove or alter. Wrought iron fences also present problems, such as rusting. Recently, plastic has been used in place of wood and metal because it is easier to install, needs little maintenance and is aesthetically appealing without the problems associated with wood and metal.

Fence construction and assembly is generally well known. The individual components of a fence are fastened to vertical posts using various types of connectors. Common connectors include nails, screws, bolts, wire and clips. Various connectors exist and are continually developed in order to facilitate fence installation and maintenance.

The present invention relates to the assembly and installation of decorative fencing and connectors between fence segments of the fencing. The present invention is a fence assembly that may be for relatively short flower garden fence to relatively tall border fence, is aesthetically appealing, and may be used in such places as along roads, and around yards, decks, gardens and flower beds. In one exemplary embodiment, a fence segment may be comprised of two horizontal, hollow channel rails that are substantially continuous for about the entire length of the fence segment. A plurality of vertical pickets or other vertical members may be attached to the two horizontal, hollow channel rails in order to form a fence segment. Each fence segment may then be attached to another fence segment by connectors adapted to be secured to the horizontal, hollow channel rails of the fence segment.

The present invention provides in-line connectors, living hinge connectors, male/female hinged connectors and end caps, each of which may be adapted to be secured to an end of a horizontal, hollow channel rail of a fence segment. Preferably, the connectors are used to connect the fence segments via the horizontal, hollow channel fence rails. The connectors provide quick and easy installation and maintenance of the fence segments, as contrasted with nails or other fastening devices. The connectors may also be hidden, at least partially, inside the vinyl rail segments providing an aesthetic appeal to the fence. The end caps may be used when another fence segment does not need to be attached. The end caps provide an aesthetic and protective cover to the end of the horizontal, hollow channel fence rails. The connectors may be adapted to fit by a friction fit or press fit into the hollow channels, or by any other known connection means, such as screws, adhesives, clips, etc.

The fence segments, connectors and end caps may be made from various types of material. An exemplary material used to make the connectors and end caps, as well as the fence segments, is polyvinyl chloride (PVC). However, the material type is not limited to PVC since the fence segments, connectors and end caps may be made from other materials such as other plastics, woods, or metals.

In addition to the novel features and advantages mentioned above, other objects and advantages of the present invention will be readily apparent from the following descriptions of the drawings and exemplary embodiments.

DETAILED DESCRIPTION OF EXEMPLARY EMBODIMENT(S)

Figure 1:
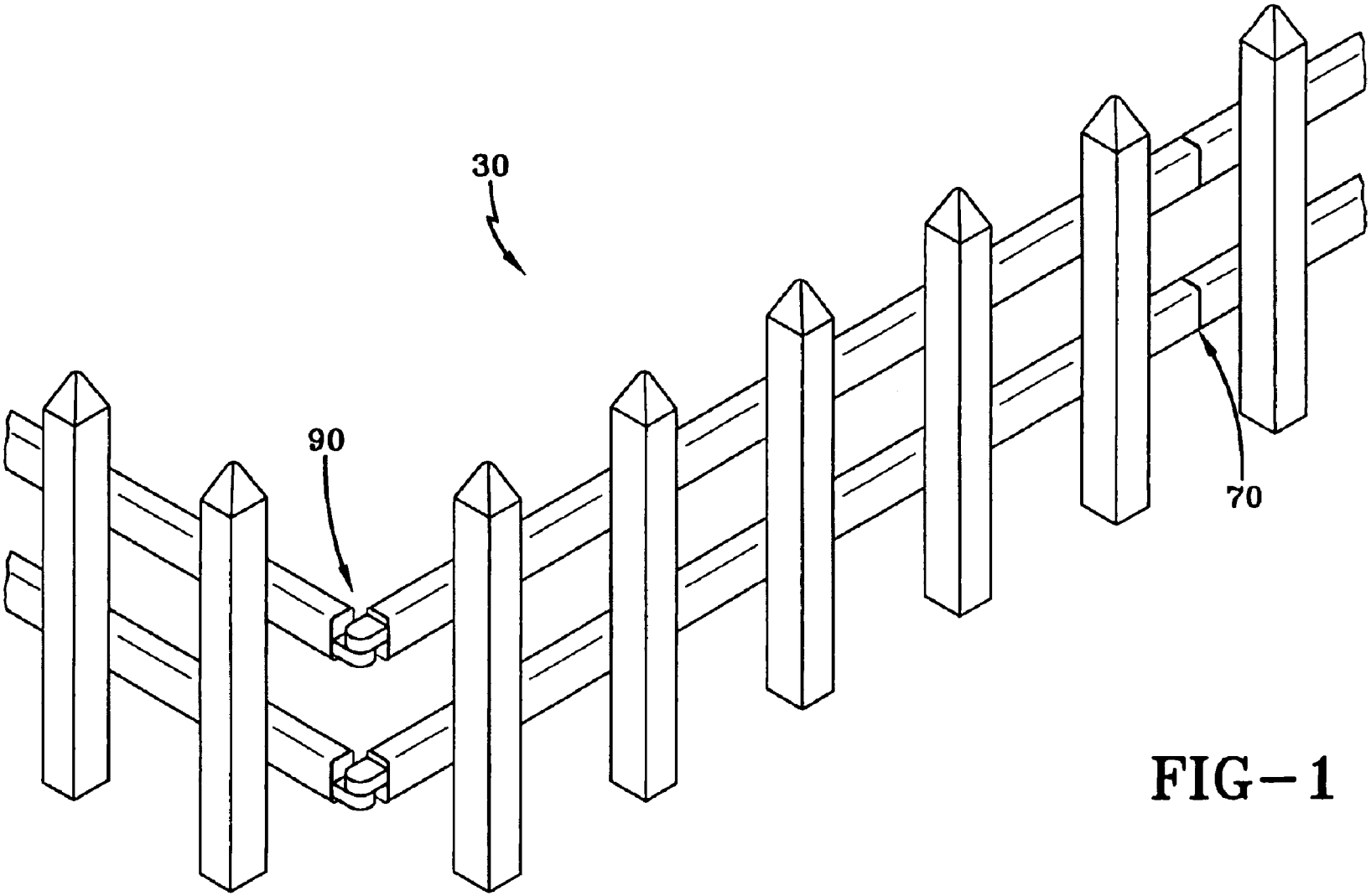
FIG. 1 illustrates a perspective view of an exemplary embodiment of the fence segments and connector assembly having an in-line connection and a male/female hinged connection.

An overall arrangement of an exemplary construction of the fence segments 30, the in-line connector 70 and the male/female hinged connector 90 is shown in FIG. 1. An in-line connector 70 may be used to attach fence segments 30 so that a substantially straight line is formed by the fence segments 30, while a male/female hinged connector 90 or a living hinge connector 80 may be used to form a corner or a varied degree of bend between the fence segments 30 thereby defining a fence.

Each fence segment 30 may be comprised of at least one horizontal, hollow channel rail 34. At least one vertical picket post 36 may be attached to the horizontal, hollow channel rails 34 in order to form a fence segment 30.

Figure 2:
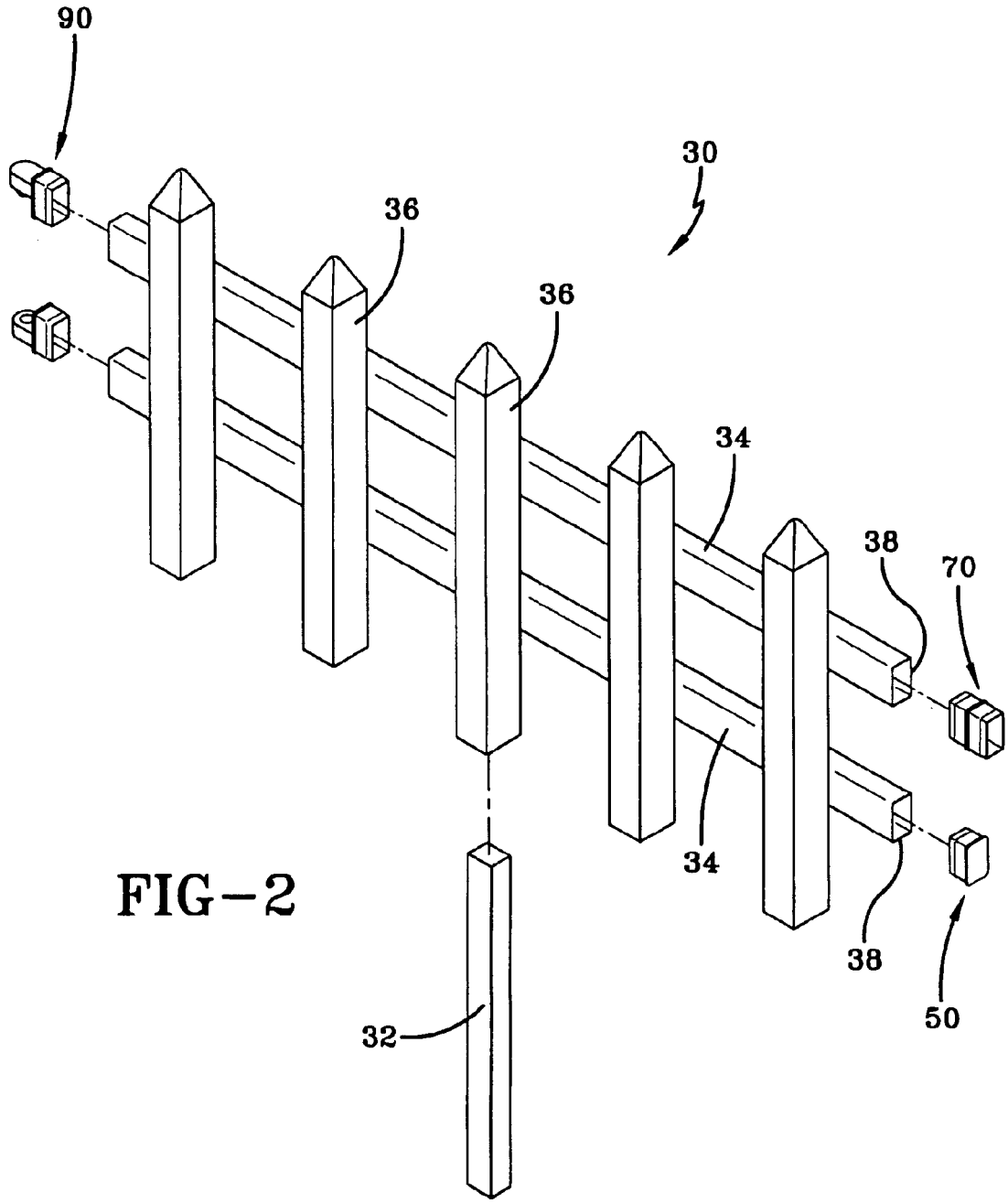
FIG. 2 illustrates an exploded perspective view of an exemplary embodiment of a fence segment assembly showing the end caps and connectors fitting into the horizontal, hollow channel rails of the fence segment.

An exemplary method of assembly of the fence segments 30 and connectors is depicted in FIG. 2. First, at least one ground stake 32 may be inserted into the ground in a location where a fence segment 30 is to be placed. A fence segment 30 may then placed over the ground stake 32. Specifically, one of the hollow vertical picket posts 36 may be positioned over the fixed ground stake 32 as the fence segment 30 is lowered into place. The ground stake 32 provides stability and stationary support to the fence segment 30. Once the fence segment 30 is in place, a connector 70, 80, 90 and/or an end cap 50 may be inserted into the ends 38 of the horizontal, hollow channel rails 34 of the fence segment 30 in a secure manner, such as, but not limited to, by friction fit, press fit or adhesive bonding. The type of connector 70, 80, 90 or end cap 50 used will depend on the desired arrangement of fence segments 30.

After a connector is inserted into the horizontal, hollow channel rails 34 of a fence segment 30, another fence segment 30 may be attached to the reciprocal end of the connector. This allows the fence segment 30 to be positioned in order to conform to the desired fence arrangement. If an end cap 50 is used instead of a connector, and the fence may end at that point.

Figure 3:
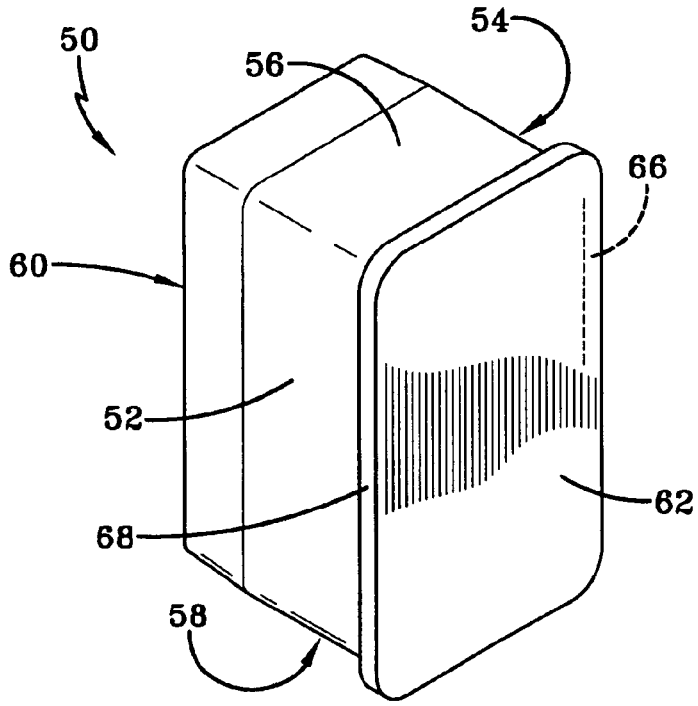
FIG. 3 illustrates a perspective view of an exemplary embodiment of an end cap.
Figure 4:
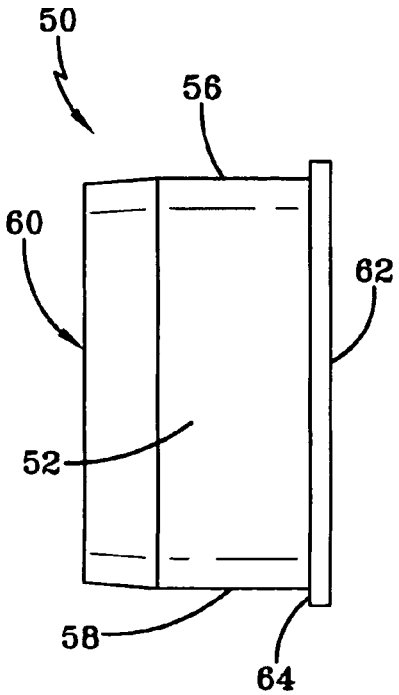
FIG. 4 illustrates a side elevation view of an exemplary embodiment of an end cap.

Each connector may have a basic body configuration similar to the end cap 50. An exemplary embodiment of an end cap 50 is depicted in FIGS. 3 and 4. An end cap 50 may be comprised of a first side wall 52 and a second side wall 54. A first end wall 56 and a second end wall 58 may be attached to the side walls 52, 54 forming a generally rectangular channel body 60. The first side wall 52 and second side wall 54 may be about equal in length and may be about parallel, while the first end wall 56 and second end wall 58 may be about equal in length and may be about parallel. The side walls 52, 54 may be of a length greater than the length of the end walls 56, 58. A terminal wall 62 may be attached to the rectangular channel body 60 at one of the two faces such that the terminal wall 62 may be about perpendicular to the side walls 52, 54 and end walls 56, 58. The terminal wall 62 may be of such a size that it is slightly larger than the perimeter of the channel body 60 so that a ledge 64 may be formed around the entire perimeter of the channel body 60. Also, it should be recognized that the terminal wall 62 in some embodiments may have an inner aperture defined by ledge 64. The configuration of the terminal wall 62 and the rectangular channel body 60, defined by a first side wall 52, second side wall 54, first end wall 56 and second end wall 58, preferably forms an end cap 50.

The size of the rectangular channel body 60, defined by the first side wall 52, second side wall 54, first end wall 56 and second end wall 58, may be such that a friction fit is formed when the channel body 60 is inserted into a horizontal, hollow channel rail 34 of a fence segment 30 and the outer surfaces of the channel body 60 come in contact with the inner surface of the horizontal, hollow channel rail 34 of a fence segment 30. The channel body 60 may be inserted into the horizontal, hollow channel rail 34 until the ledge 64 of the terminal wall 62 comes in contact with the end 38 of the horizontal, hollow channel rail 34. This prevents the end cap 50 or connectors from being inserted too far into the end 38 of the horizontal, hollow channel rail 34 and provides a secure fit for the end cap 50 or connectors.

Figure 5:
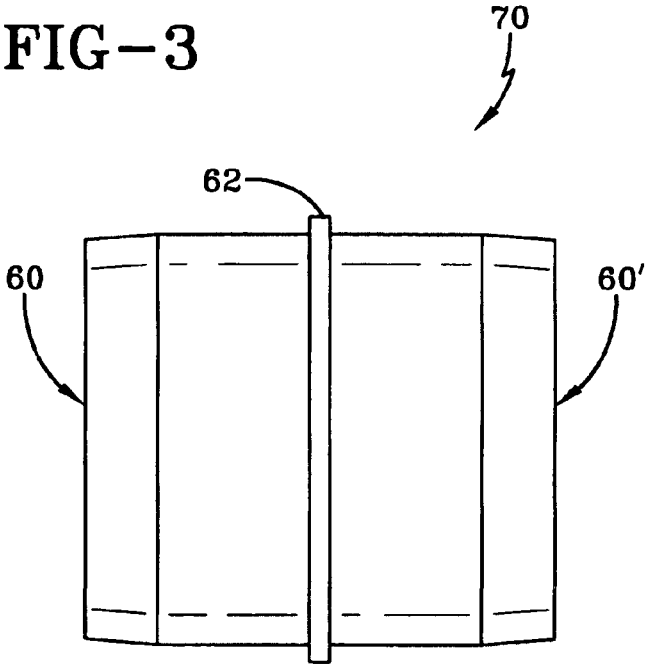
FIG. 5 illustrates a side elevation view of an exemplary embodiment of an in-line connector.

Each of the connectors may have a body configuration similar to the end cap 50, with the addition of a connecting element attached to the terminal wall 62. An exemplary embodiment for a friction fit in-line connector 70, as shown in FIG. 5, contains a channel body 60 with terminal wall 62 configuration. As a connecting element, a second channel body 60' may be attached to the terminal wall 62 in a similar manner as the first channel body 60 may be attached to the terminal wall 62, as described above.

Figure 6:
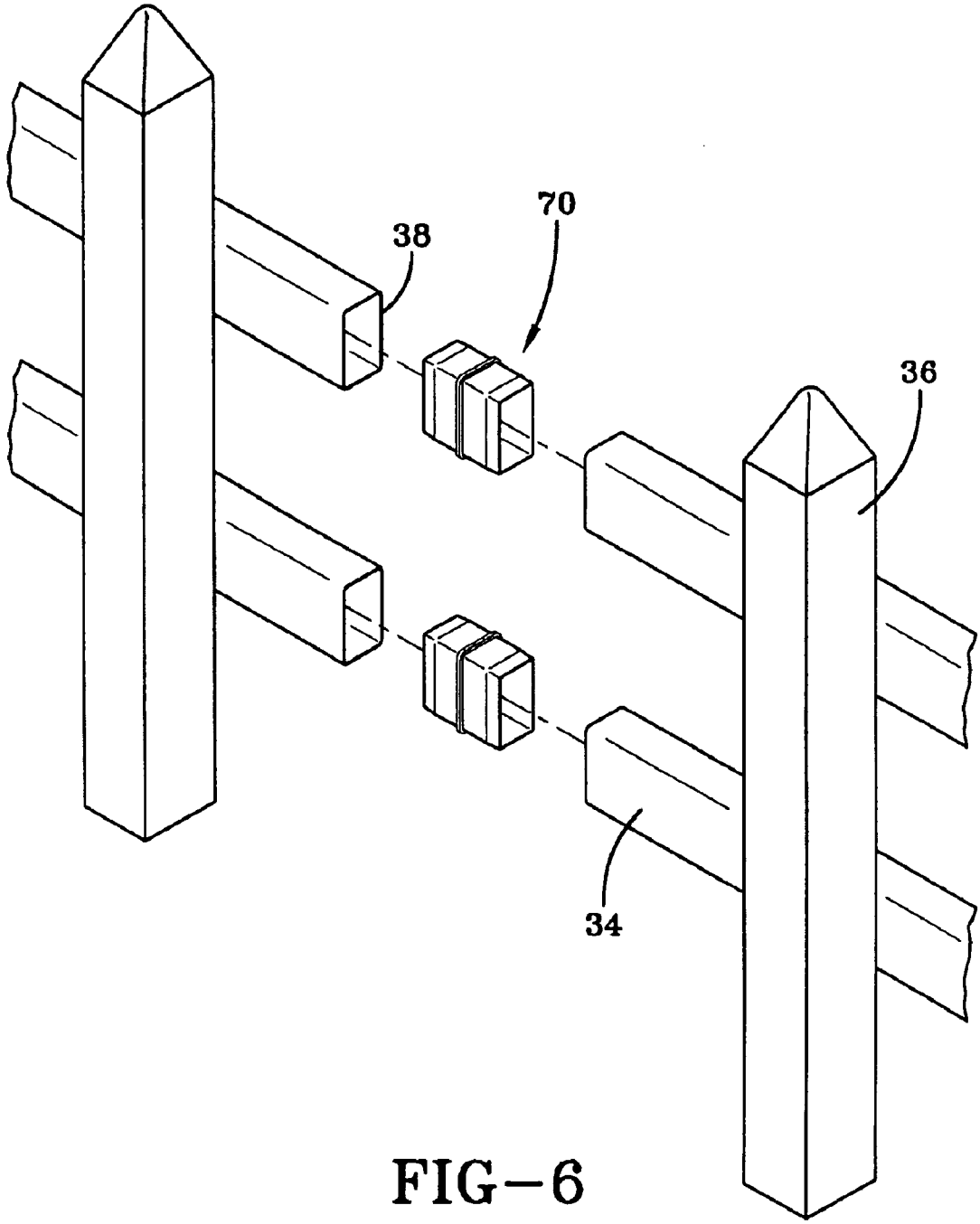
FIG. 6 illustrates a perspective view of an exemplary embodiment of an in-line connection formed by the in-line connectors and the horizontal, hollow channel rails of the fence segments.

When an in-line connector 70 has been inserted into a fence segment 30, a horizontal, hollow channel rail 34 of a second fence segment 30 may then be positioned over the second channel body 60' of the friction fit in-line connector 70 in a similar manner as described above. The arrangement of attaching two fence segments 30 by friction fit in-line connectors 70 is depicted in FIG. 6.

Figure 7:
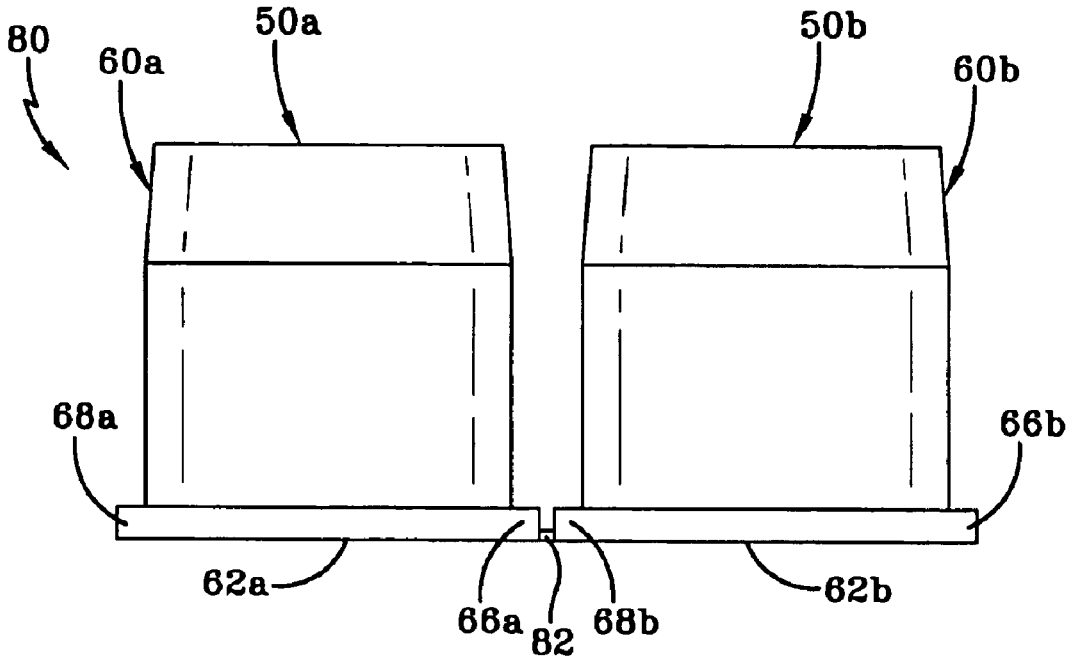
FIG. 7 illustrates an end view of an exemplary embodiment of a living hinge connector.
Figure 8:
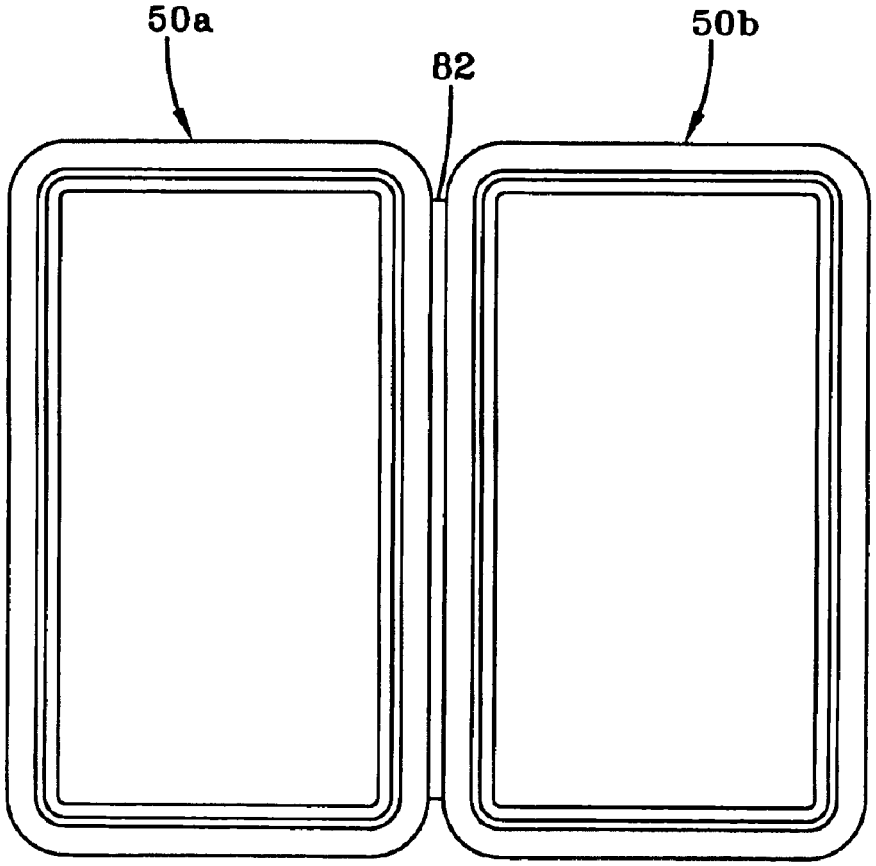
FIG. 8 illustrates a plan view of the living hinge connector shown in FIG. 7.
Figure 9:
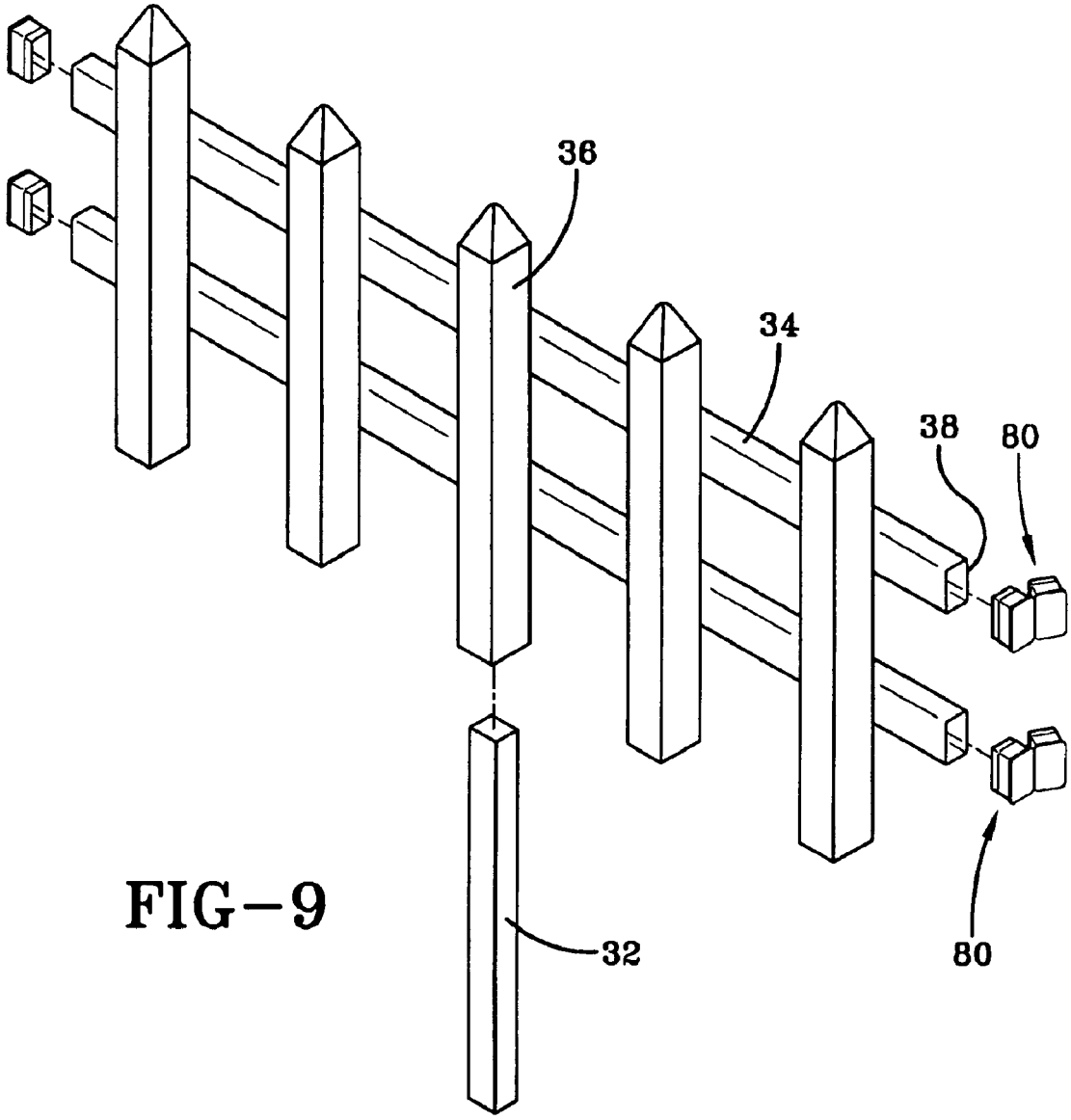
FIG. 9 illustrates a perspective view of an exemplary embodiment of a fence segment assembly showing the living hinge connectors fitting into the horizontal, hollow channel rails of a fence segment.

Another exemplary embodiment of a connector may be a hinged connector. An exemplary embodiment of a hinged connector may be a living hinge connector 80 as shown in FIGS. 7 through 9. The exemplary embodiment of a living hinge connector 80 may be formed by affixing two end caps 50*a*, 50*b* together with a flexible joining member 82. Specifically, a flexible joining member 82 may affix a first peripheral edge 66*a* of a terminal wall 62*a* on a first end cap 50*a* to a second peripheral edge 68*b* of a terminal wall 62*b* on a second end cap 50*b*. When the two end caps 50*a*, 50*b* are affixed to form a living hinge connector 80, the flexible joining member 82 may form a continuous face with the outer surface of each of the terminal walls 62*a*, 62*b* on each of the end caps 50*a*, 50*b*, as shown in FIG. 7. The flexible joining member 82 may be comprised of the same material as each end cap 50*a*, 50*b* and may be of a sufficient thickness and flexibility to allow flexing in either direction when forces are applied.

The channel body 60*a* of the first end cap 50*a* of a living hinge connector 80 may be inserted into an end 38 of a horizontal, hollow channel rail 34 of a fence segment 30, while the channel body 60*b* of the second end cap 50*b* of a living hinge connector 80 may be inserted into a horizontal, hollow channel rail 34 of another fence segment 30. Both channel bodies 60*a*, 60*b* of the living hinge connector 80 may form a friction fit or press fit with the corresponding horizontal, hollow channel rail of the fence segments, as described above. The living hinge connector 80 may be flexed, at the flexible joining member 82, to various degrees in order to form the desired fence arrangement.

Another exemplary embodiment of a hinged connector used in conjunction with the fence assembly of the present invention may be a male/female hinged connector 90 as depicted in FIGS. 10 through 14. This connector may preferably be a two component assembly, namely a female component 92 and a male component 102. Each component 92, 102 may contain a similar channel body 60 with terminal wall 62 configuration, as in forming an end cap 50, as the base of each component 92, 102. A connecting element 94, 104 may be attached to the outer face of the terminal wall 62*c*, 62*d* of each component 92, 102.

Figure 10:
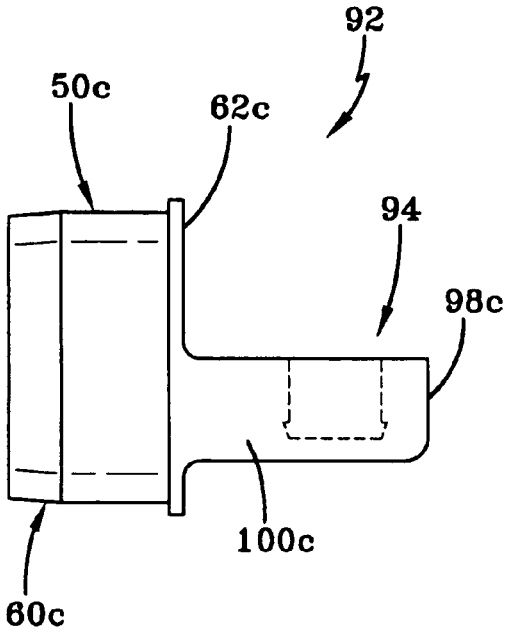
FIG. 10 illustrates a side elevation view of an exemplary embodiment of a female component of a male/female hinged connector.
Figure 11:
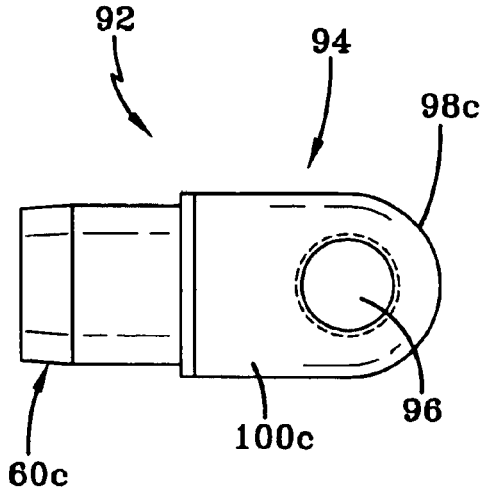
FIG. 11 illustrates a plan view of the female component of FIG. 10.

The connecting element for a female component 92 is shown in FIGS. 10 and 11. The female connecting element 94 may be comprised of an arm 100*c* attached to the outer surface of the terminal wall 62*c* of the end cap base 50*c*. In an exemplary embodiment, the arm 100*c* may be affixed slightly below the midpoint of the terminal wall 62*c*. The arm 100*c* may project from and may be approximately perpendicular to the outer surface of the terminal wall 62*c*. An aperture 96 may be located near the free end 98*c* of the arm 100*c*. The aperture 96 may be of a size that will accept and lock in a male connecting element 104 of a male component 102 of a male/female hinged connector 90.

Figure 12:
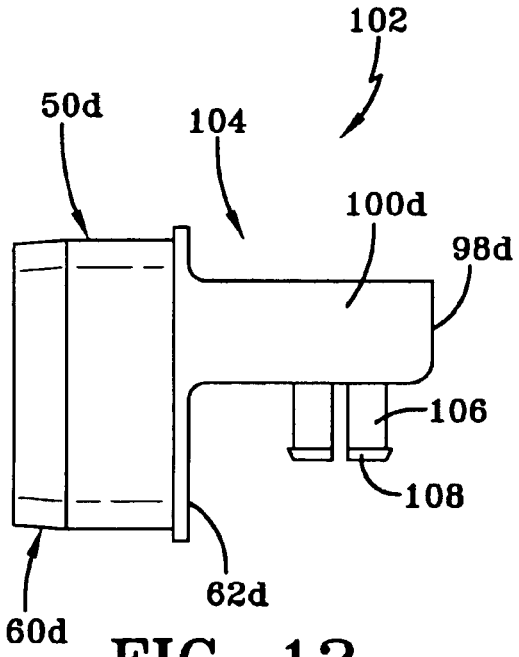
FIG. 12 illustrates a side elevation view of an exemplary embodiment of a male component of a male/female hinged connector.
Figure 13:
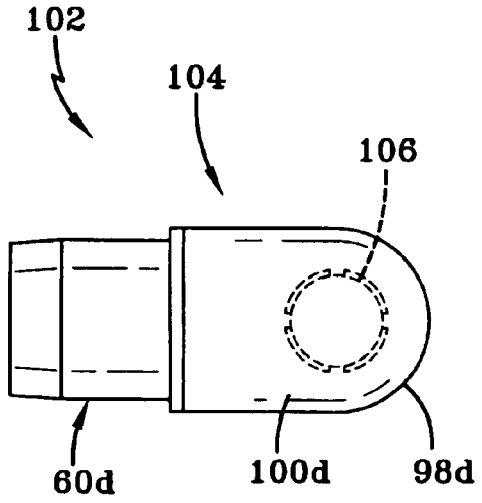
FIG. 13 illustrates a bottom plan view of the male component of FIG. 12.
Figure 14:
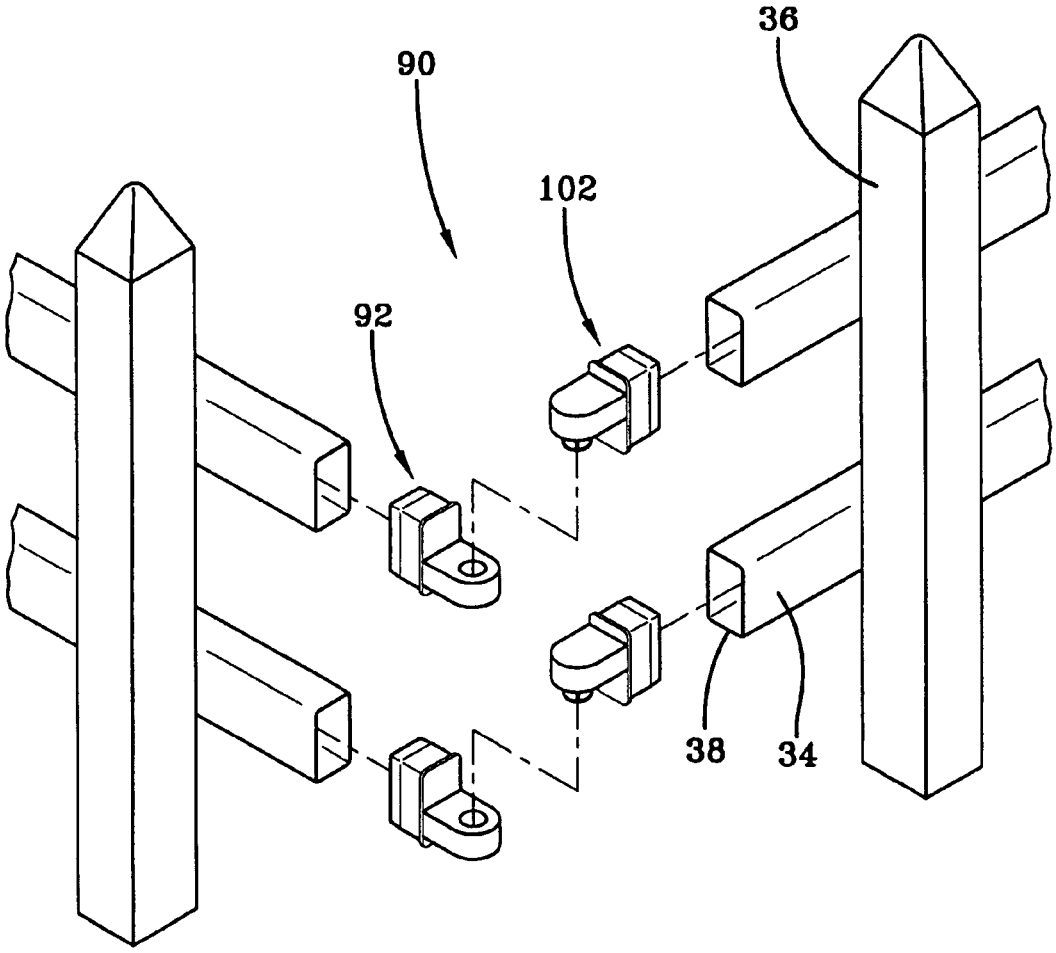
FIG. 14 illustrates a perspective view of an exemplary embodiment of the male/female hinged connection formed by the male/female hinged connectors and the horizontal, hollow channel rails of the fence segments.

The connecting element for a male component 102 is shown in FIGS. 12 and 13. The male connecting element 104 may be comprised of an arm 100*d* attached to the outer surface of the terminal wall 62*d* of the end cap base 50*d*. For example, the arm 100*d* may be affixed slightly above the midpoint of the terminal wall 62*d*. The arm 100*d* may project from and may be approximately perpendicular to the outer surface of the terminal wall 62*d*. A circular array of projections 106 may be attached to and extend downwardly from the bottom surface of the arm 100*d* near its free end 98*d*. An exemplary embodiment of the male component 102 may have four curved projections 106 that may be about the same size and length, and may be about equidistant apart. However, the male component 102 may have one or any number of variously shaped projections. In an exemplary embodiment, the circular array of projections 106 has a diameter that is able to fit into the aperture 96 on the female connecting element 94.

Each projection 106 may have a lip 108 near the free end of the projection 106. The lip 108 may be about parallel to the free end of the projection 106 and may be used to lock the male connecting element 104 into the aperture 96 of the female connecting element 94 once the circular array of projections 106 has been inserted into the aperture 96. This may allow the male and female connecting elements 104, 94 to interlock while allowing pivotal rotation of the hinging mechanism of the male/female hinged connector 90.

The channel bodies 60*c*, 60*d* of the male component 102 and the female component 92 of the male/female hinged connector 90 may each be inserted into an end 38 of a horizontal, hollow channel rail 34 of a fence segment 30 in a similar manner as described above and depicted in FIG. 14. Specifically, the female component 92 may be inserted into the horizontal, hollow channel rails 34 of a fence segment 30, while the male component 102 may be inserted into the horizontal, hollow channel rails 34 of another fence segment 30 that is to be connected. This male/female hinged connector 90 may be pivoted to various degrees and in either direction in order to form the desired fence arrangement.

An exemplary material used to make the fence segments 30, connectors 70, 80, 90 and end caps 50 is polyvinyl chloride (PVC). However, a variety of other materials, such as other plastics, woods, and metals, may be used. The segments, connectors, and end caps may be extruded, compression molded, injection molded or made using any other suitable techniques.

As discussed in detail above, the present invention allows for a various number and arrangement of fence segments, connectors and end caps to be used in order to form a desired fence assembly.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A fence assembly comprising:

a ground stake;

a first fence segment and a second fence segment, each fence segment having a picket post and a hollow channel rail which is substantially continuous for the length of said fence segment, each hollow channel rail having two ends, said ground stake fitting inside said picket post of one of said fence segments; and a connector inserted into said end of said hollow channel rail of said first fence segment and into said end of said hollow channel rail of said second fence segment, thereby securing said fence segments together, said connector comprising:

a channel body defined by a first side wall, a second side wall, a first end wall, and a second end wall, said channel body having two faces;

a terminal wall connected to said channel body at one of said faces of said channel body, said terminal wall having an outer surface and a peripheral edge; and a connecting element connected to said terminal wall, said connecting element comprising:

a second channel body defined by a first side wall, a second side wall, a first end wall, and a second end wall, said second channel body having two faces;

a second terminal wall connected to said second channel body at one of said faces of said second channel body, said second terminal wall having an outer surface and a peripheral edge; and a flexible joining member connecting said peripheral edge of said second terminal wall to said peripheral edge of said first terminal wall, thereby forming a living hinge.

2. The fence assembly as defined in claim 1, wherein said first side wall and said second side wall of said second channel body are substantially parallel and equal in length.

3. The fence assembly as defined in claim 1, wherein said first end wall and said second end wall of said second channel body are substantially parallel and equal in length.

4. The fence assembly as defined in claim 1, wherein said first end wall and said second end wall of said second channel body are of a length shorter than said first side wall and said second side wall of said second channel body.

5. The fence assembly as defined in claim 1, wherein said second terminal wall is substantially perpendicular to said second channel body and is of a size slightly larger than the perimeter of said second channel body, thereby forming a ledge around said second channel body.

6. The fence assembly as defined in claim 1, wherein said first channel body and said second channel body are substantially similar in size and shape.

7. The fence assembly as defined in claim 1, wherein said first terminal wall and said second terminal wall are substantially similar in size and shape.

8. A fence assembly comprising:

a ground stake;

a first fence segment and a second fence segment, each fence segment having a picket post and a hollow channel rail which is substantially continuous for the length of said fence segment, each hollow channel rail having two ends, said ground stake fitting inside said picket post of one of said fence segments; and a connector inserted into said end of said hollow channel rail of said first fence segment and into said end of said hollow channel rail of said second fence segment, thereby securing said fence segments together, said connector comprising;

a channel body defined by a first side wall, a second side wall, a first end wall, and a second end wall, said channel body having two faces, said first side wall and said second side wall being substantially parallel and equal in length and said first end wall and said second end wall being substantially parallel and equal in length such that said first end wall and said second end wall are of a length shorter than said first side wall and said second side wall;

a terminal wall connected to said channel body at one of said faces of said channel body, said terminal wall having an outer surface and a peripheral edge, said terminal wall being substantially perpendicular to said channel body and of a size slightly larger than the perimeter of said channel body, thereby forming a ledge around said channel body; and a connecting element connected to said terminal wall, said connecting element comprising:

a second channel body defined by a first side wall, a second side wall, a first end wall, and a second end wall, said second channel body having two faces, said first side wall and said second side wall of said second channel body being substantially parallel and equal in length and said first end wall and said second end wall of said second channel body being substantially parallel and equal in length such that said first end wall and said second end wall of said second channel body are of a length shorter than said first side wall and said second side wall of said second channel body;

a second terminal wall connected to said second channel body at one of said faces of said second channel body, said second terminal wall having an outer surface and a peripheral edge, said second terminal wall being substantially perpendicular to said second channel body and of a size slightly larger than the perimeter of said second channel body, thereby forming a ledge around said second channel body; and a flexible joining member connecting said second peripheral edge of said second terminal wall to said first peripheral edge of said first terminal wall, thereby forming a living hinge.

9. The fence assembly as defined in claim 8, wherein:

said first channel body and said second channel body are substantially similar in size and shape; and said first terminal wall and said second terminal wall are substantially similar in size and shape.

10. A fence assembly comprising:

a ground stake;

a first fence segment and a second fence segment, each fence segment having a picket post and a hollow channel rail which is substantially continuous for the length of said fence segment, each hollow channel rail having two ends, said ground stake fitting inside said picket post of one of said fence segments; and a connector inserted into said end of said hollow channel rail of said first fence segment and into said end of said hollow channel rail of said second fence segment, thereby securing said fence segments together, said connector comprising:

a base member;

a channel body having two faces, said channel body defined by a first side wall, a second side wall, a first end wall, and a second end wall;

a terminal wall connected to said channel body at one of said faces of said channel body, said terminal wall having an outer surface and a peripheral edge; and a flexible joining member connecting said peripheral edge of said terminal wall to said base member, thereby forming a living hinge.

11. The fence assembly as defined in claim 10, wherein said first side wall and said second side wall are substantially parallel and equal in length.

12. The fence assembly as defined in claim 10, wherein said first end wall and said second end wall are substantially parallel and equal in length.

13. The fence assembly as defined in claim 10, wherein said first end wall and said second end wall are of a length shorter than said first side wall and said second side wall.

14. The fence assembly as defined in claim 10, wherein said terminal wall is substantially perpendicular to said channel body and is of a size slightly larger than the perimeter of said channel body, thereby forming a ledge around said channel body.

15. A fence assembly comprising:

a ground stake;

a first fence segment and a second fence segment, each fence segment having a picket post and a hollow channel rail which is substantially continuous for the length of said fence segment, each hollow channel rail having two ends, said ground stake fitting inside said picket post of one of said fence segments; and a connector inserted into said end of said hollow channel rail of said first fence segment and into said end of said hollow channel rail of said second fence segment, thereby securing said fence segments together, said connector comprising:

a base member;

a channel body having two faces, said channel body defined by a first side wall, a second side wall, a first end wall, and a second end wall, said first side wall and said second side wall being substantially parallel and equal in length and said first end wall and said second end wall being substantially parallel and equal in length such that said first end wall and said second end wall are of a length shorter than said first side wall and said second side wall;

a terminal wall connected to said channel body at one of said faces of said channel body, said terminal wall being substantially perpendicular to said channel body and of a size slightly larger than the perimeter of said channel body such that a ledge is formed around said channel body, said terminal wall having an outer surface and a peripheral edge; and a flexible joining member connecting said peripheral edge of said terminal wall to said base member, thereby forming a living hinge.

* * * * *